US005896952A

United States Patent [19]

Döhring et al.

[11] Patent Number: 5,896,952

[45] Date of Patent: Apr. 27, 1999

[54] APPARATUS FOR COUPLING ELEVATOR DOORS

[75] Inventors: Rüdiger Döhring, Berlin, Germany; Ivo Siebers, Root, Switzerland

[73] Assignee: Inventio AG, Hergiswil NW., Switzerland

[21] Appl. No.: 08/907,837

[22] Filed: Aug. 14, 1997

[30] Foreign Application Priority Data

Aug. 22, 1996 [EP] European Pat. Off. ..... 96810556

[51] Int. Cl.[6] ..... B66B 13/12

[52] U.S. Cl. ..... 187/330; 49/120

[58] Field of Search ..... 187/330, 319; 49/116, 122, 120

[56] References Cited

U.S. PATENT DOCUMENTS

| | | | |
|---|---|---|---|
| 2,077,659 | 4/1937 | Bancroft | 187/52 |
| 2,432,293 | 12/1947 | Giovanni | 187/52 |
| 2,996,152 | 8/1961 | Olexson et al. | 187/52 |
| 5,105,916 | 4/1992 | Steacy et al. | 187/52 LC |
| 5,485,896 | 1/1996 | Kowalczyk et al. | 187/330 |
| 5,651,428 | 7/1997 | Ahigian et al. | 187/330 |

FOREIGN PATENT DOCUMENTS

| | | |
|---|---|---|
| 2 376 814 | 8/1978 | France . |
| 365844 | 11/1962 | Switzerland . |
| 655824 | 8/1951 | United Kingdom . |

*Primary Examiner*—Kenneth Noland

*Attorney, Agent, or Firm*—MacMillan, Sobanski & Todd, LLC

[57] ABSTRACT

A door coupling apparatus for establishing and releasing an operative connection between an elevator car door and an elevator shaft door includes a drive unit (D, P) mounted on the car door for moving a roller double lever (1) into engagement with an entraining element (21) on the shaft door. A thrust/rotation drive unit (D) has a rotary drive (9) coupled to a lever axle (3) of the roller double lever (1) by an entraining disc (8), a coupling pin (7) and a coupling ring (6) to axially displace the roller double lever, and a guide pin (11) extending from the lever axle to engage a curved guide slot (10) to rotate the roller double lever. A passive drive unit (P) has an actuating cam (32) with a guide slot (36) formed therein for engaging an actuating roller (37) attached to the coupling pin (7) to produce the rotation and extension of the roller double lever (1). The rotatable and, in particular, retractable roller double lever (1) and the arrangement thereof above the door leaves (16.1, 16.2) provides for a very small threshold gap (35).

8 Claims, 2 Drawing Sheets

APPARATUS FOR COUPLING ELEVATOR DOORS

BACKGROUND OF THE INVENTION

The present invention relates to an apparatus for coupling elevator car doors with shaft doors.

Elevator door coupling devices with movable cam parallelograms at the car door, which engage in a roller pair at the shaft door and entrain the shaft door in the case of previous unlocking, are generally known.

Further, devices are known with rollers which are spread by rotation of a roller lever at the car door and straight arms at the shaft door in which the rollers engage.

The Swiss patent specification No. 365 844 shows a respective rotatable roller double lever at each of a shaft door and a car door, which lever stands in operative connection with the corresponding counter means at the opposite door. During opening, the roller double lever is rotated indirectly by the door drive by way of the counter means for the purpose of unlocking and, after the unlocking, the entrainment of the opposite door takes place, but certainly not free of play, because only one roller rests in the entraining element.

The U.S. Pat. No. 2,432,293 shows a shaft door entrainer at the car door with a rotatable roller double lever, which in the coupled state embraces a vertical entraining straight arm at the shaft door and entrains this free of play. The roller double lever is actuated or rotated by an auxiliary drive, which is derived from the door drive, by way of a cam disc.

The door coupling shown in the U.S. Pat. No. 5,105,916 similarly employs a rotatable roller double lever, wherein during opening this is rotated by an actuating lever until a straight arm at the shaft door is engaged around and the shaft door is entrained.

A rotating door coupling is shown in the U.S. Pat. No. 5,485,896. In this case, in the region of the door zone, a roller double lever is rotated by an actuator until both rollers lie against the inner walls of a sheet metal channel arranged at the shaft door and entrain the shaft door.

All solutions known hitherto can be realized only with a relatively large threshold gap between the car and the floor. The threshold gap must necessarily be as large as the engagement depth of the entraining means plus a tolerance distance of at least 5 millimeters. That results in threshold gaps of, for example, 20 to 25 millimeters. Such threshold gaps are an obstacle for roller trolleys with small wheels and moreover can involve an accident risk through catching of shoe heels. Furthermore, smaller objects can fall down into the elevator shaft.

SUMMARY OF THE INVENTION

The present invention concerns a door coupling apparatus for establishing and releasing an operative connection between an elevator car door and an elevator shaft door by use of entraining elements on the car door, which elements are spread by rotation and engage in an entraining element in the floor zone at the shaft door and thus entrain the shaft door free of play during door opening at the floor. The coupling apparatus includes a drive unit mounted on the car door for moving a roller double lever into engagement with an entraining element on the shaft door. A thrust/rotation drive unit has a rotary drive coupled to a lever axle of the roller double lever by an entraining disc, a coupling pin and a coupling ring to axially displace the roller double lever, and a guide pin extending from the lever axle to engage a curved guide slot to rotate the roller double lever. A passive drive unit has an actuating cam with a guide slot formed therein for engaging an actuating roller attached to the coupling pin to produce the rotation and extension of the roller double lever. The rotatable and, in particular, retractable roller double lever and the arrangement thereof above the door leaves provides for a very small threshold gap.

It is an object of the present invention to provide an elevator door coupling device enables a very small threshold gap between the car door threshold and the shaft door threshold, e.g., smaller than 10 millimeters.

It is another object of the present invention to mount the coupling device at the head parts of the doors which are not visible.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
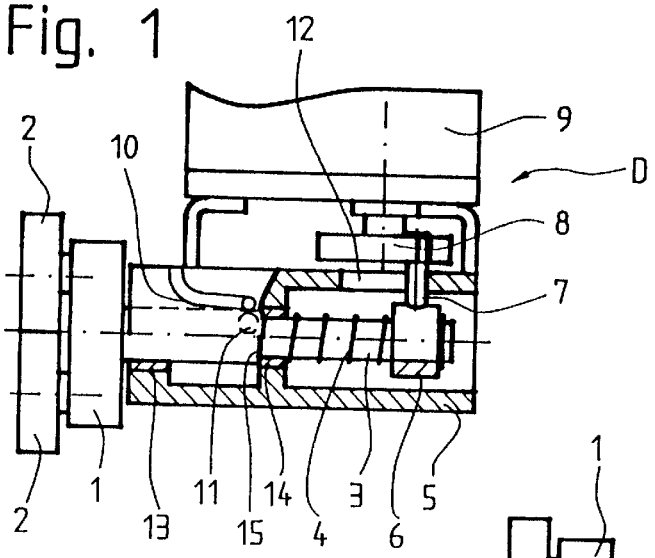
FIG. 1 is a top plan view in partial cross section of a thrust/rotation unit with roller double lever in a starting setting in accordance with the elevator door coupling apparatus according to the present invention.

A thrust/rotation drive unit D for an elevator door coupling apparatus is illustrated in the FIG. 1, and essentially consists of a rotary drive 9 which is assembled with a guide sleeve 5. A lever axle or shaft 3, rotatable in an outer bearing 13 and an inner bearing 14 is mounted in the guide sleeve 5 to be axially displaceable and rotatable therein. The lever shaft 3 is disposed in a retracted starting position wherein a shoulder 15 formed thereon is close to a left-hand edge of the inner bearing 14. The axle 3 extends through a helical spring 4 which is under bias between the right-hand edge of the inner bearing 14 and a coupling ring 6 which is axially fixed, but rotatable, at the right-hand end of the lever axle.

Radially fastened in the coupling ring 6 is a coupling pin 7, which pin projects outwardly through an axial guide slot 12 formed in the guide sleeve 5 and is guided in a radial slot of an entraining disc 8 rotated by the rotary drive 9 and thus produces the operative connection between the rotary drive and the lever shaft 3.

A guide pin 11, which projects outwardly through a curved guide slot 10 formed in the guide sleeve 5, is radially inserted into the lever shaft 3 at the left behind the shoulder 15. The curved guide slot 10 extends initially in an axial direction and then bends in about the last third along a radius, which radius is adapted to the function, turning upwardly away, of causing the rotation of the lever shaft 3 just in the last third of an outward displacement movement. A roller double lever 1, which carries a respective roller 2 at its two ends, is fastened to the left-hand end of the lever shaft 3.

Figure 2:
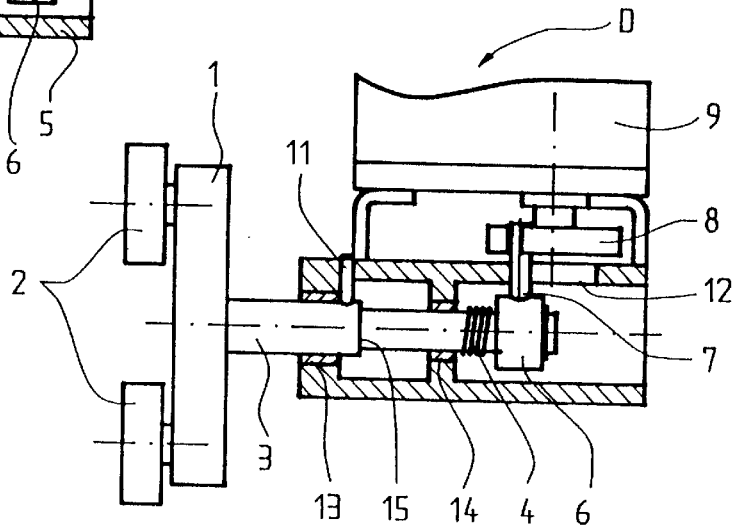
FIG. 2 is a view similar to the FIG. 1 showing the thrust/rotation unit and roller double lever in a driven-out setting.
Figure 3:
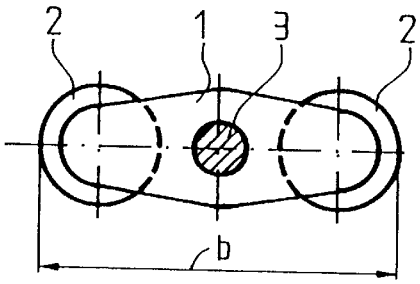
FIG. 3 is a front elevation view of the roller double lever in the driven-out setting of the FIG. 2.
Figure 4:
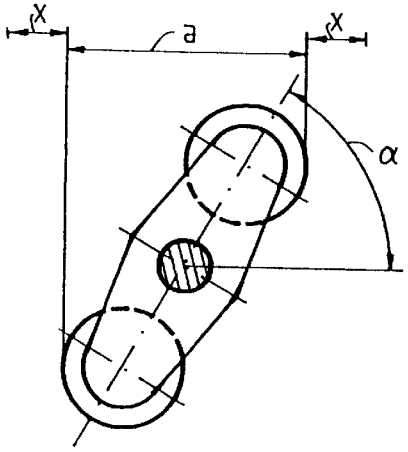
FIG. 4 is a front elevation view of the roller double lever in the starting setting of the FIG. 1.

In the FIG. 2, the lever shaft 3 together with the roller double lever 1 is shown in an extended position (a driven-out and fully rotated setting). In that case, it is clear how much the horizontal displacement movement and the rotation amounts to by reference to the spread out rollers 2. Seen from the floor side, the roller double lever 1 is in the position shown in the FIG. 3. The FIG. 4 shows the roller double lever 1 in a retracted position (a starting setting) according to the FIG. 1 whereby the lever shaft 3 has been rotated "$\alpha$" degrees. The spreading distance "b" shown in the FIG. 3 is a maximum width which arises only when the roller double lever 1 rotation takes place without limiting entraining counter means in a form, by way of example, of straight arms at the shaft door. In the retracted starting setting, the roller double lever 1 has, by way of the rollers 2, a width "a" which is smaller than the distance between the entraining elements at the shaft door, whereby it would be guaranteed that no contact with the entraining element would arise on travel past floors without stopping. Otherwise this circumstance is not relevant for the present invention, because the roller double lever 1 is retracted into the setting according to the FIG. 4. So that the entrainment of a shaft door takes place free of play, the distance between the entraining elements is smaller than the distance "b" ("a+2x"), but greater than the distance "a".

Figure 5:
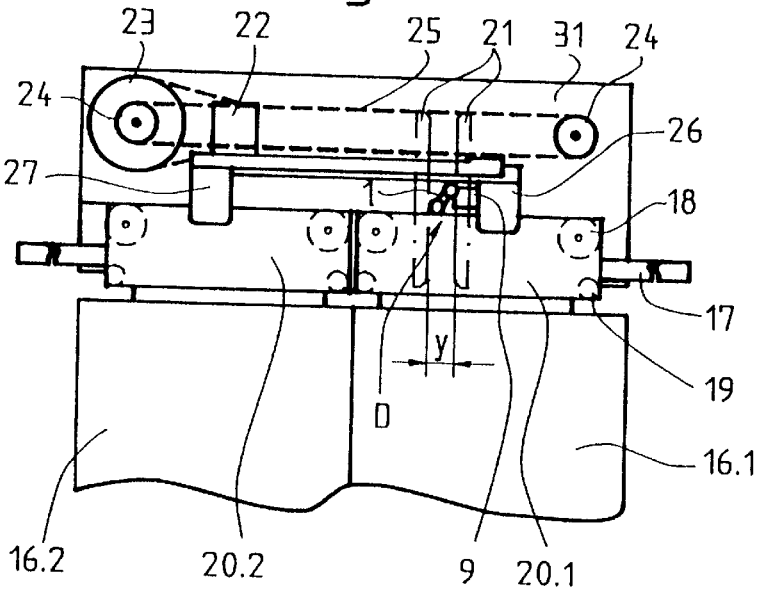
FIG. 5 is a front elevation view of the door coupling apparatus shown in the FIG. 1 mounted on an elevator car door.

In the FIG. 5, the door coupling device according to the present invention is installed at an elevator sliding door. In this front view, a door drive arranged at a door support 31 comprises a door motor 22 driving a transmission gear 23, and a set of left-hand and right-hand drive rollers 24 coupled by a drive belt 25 and driven by the gear 23. The sliding door itself consists of a right-hand door leaf 16.1 and a left-hand door leaf 16.2. The door leaves 16.1 and 16.2 are respectively coupled with a right-hand head part 20.1 and a left-hand head part 20.2. These head parts 20.1 and 20.2 are carriers of the door leaves 16.1 and 16.2, and for this purpose are each equipped with two door rollers 18 running on a guide 17 and with two counter-pressure rollers 19 running under the guide. The right-hand head part 20.1 is connected with an upper run of the drive belt 25 by way of an entrainer 26, and the left-hand head part 20.2 is connected with a lower run of the drive belt by an entrainer 27. The rotary drive 9 with the roller double lever 1 is arranged on the right-hand head part 20.1. The roller double lever 1 is disposed in this illustration in engagement between a pair of vertical straight arms 21, which arms are disposed at not-illustrated shaft doors and for this reason are shown in dashed lines. A spreading distance "y" corresponds to the spacing between the straight arms 21. With this spacing, the roller double lever 1 is still not completely rotated outwardly, but is displaced out far enough so that a secure depth of engagement is given for the entrainment of the shaft door. The door coupling device is here, for the benefit of a better clarity, illustrated only for the door leaf 16.1 with the right-hand head part 20.1 and has been omitted for the left-hand door leaf 16.2 with the left-hand head part 20.2. Also, in the case of practical realization, only one device can be used when the second door leaf is moved by the first door leaf by way of a drive element.

Figure 6:
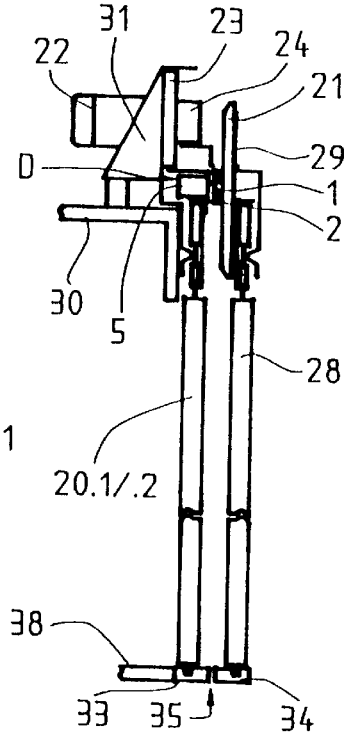
FIG. 6 is a side elevation view of the door coupling apparatus and elevator car door shown in the FIG. 5 with a shaft door and associated thresholds.

In the FIG. 6, the door shown in the FIG. 5, is illustrated in side elevation. In this illustration, the roller double lever 1 is retracted with the rollers 2 in the starting setting. The door support 31 is firmly connected with a car structure 30 of the car upper part. Corresponding to the arrangement of the door coupling device at the head parts 20.1 and 20.2 of the car door leaves 16.1 and 16.2, the entraining straight arms 21 are attached to shaft door leaves 28 at head parts 29 thereof, thus at the same height. Moreover, the FIG. 6 shows a lower partial region with a car floor 38, a car threshold profile member 33, a floor threshold profile member 34 and a threshold gap 35 between the two threshold profile members. It is clearly evident in this view how the threshold gap 35 can be kept very small thanks to the retraction function of the roller double lever 1. In an advantageous arrangement of the straight arms 21, the front edges thereof together with the front edges of the floor threshold profile member 34 lie on the same vertical line. Equally, in an advantageous embodiment, the outer end faces of the roller double lever 1, or the rollers 2 in the retracted state, together with a front edge of the car threshold profile member 33 also lie on a common vertical line. The size of the threshold gap 35 is thereby only a question of mounting tolerances and of horizontal play of the elevator car in the shaft.

Figure 7:
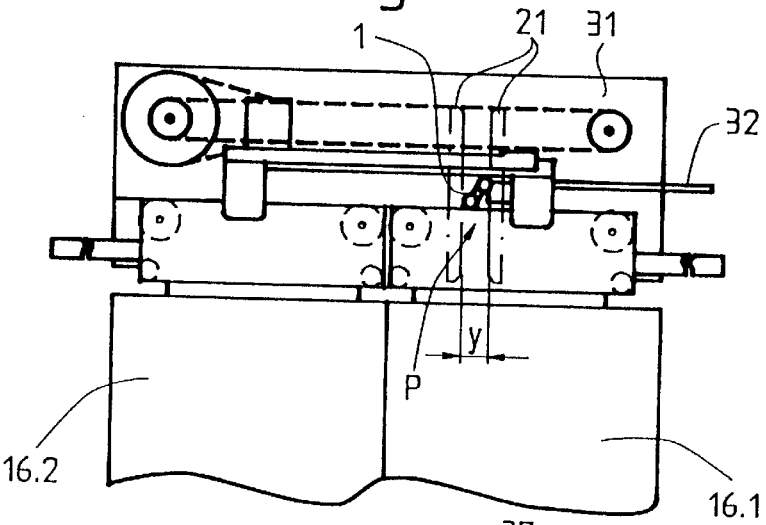
FIG. 7 is a front elevation view of an alternate embodiment elevator door coupling apparatus having a passive drive mounted on an elevator door.
Figure 8:
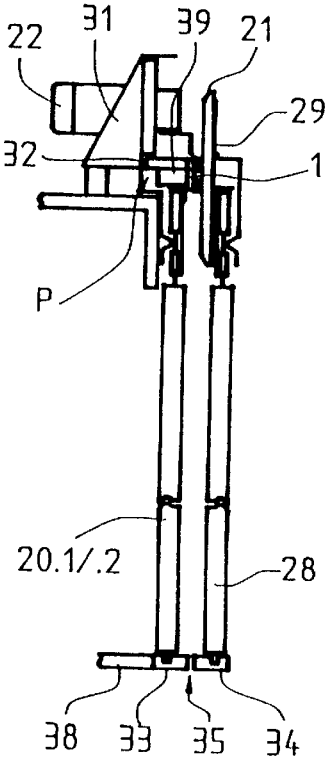
FIG. 8 is a side elevation view of the door coupling apparatus and elevator door shown in the FIG. 7 with a shaft door and associated thresholds.
Figure 9:
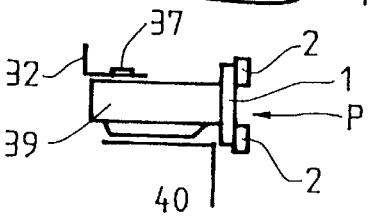
FIG. 9 is a side elevation view of the thrust/rotation unit shown in the FIG. 7 with a passive drive and an actuating cam.
Figure 10:
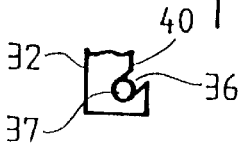
FIG. 10 is a top plan view of the actuating cam shown in the FIG. 9.

A simplified variant or alternate embodiment of the drive of the roller double lever 1 is shown in the FIGS. 7 through 10. In this case, the roller double lever 1 has no own motorized drive. Instead of the rotary drive 9, a device called a passive drive is provided. A passive drive unit P includes an actuating cam 32, which cam extends over the entire door running width and is mounted at the front wall of the door drive support 31 (FIG. 7, FIG. 8). The actuating cam 32 has, for example, an angular cross section (FIG. 9) and has at its ends, which are remote from the center of the door, formed in a horizontal limb an actuating guide slot 36 (FIG. 10) in the form of a slot inclined at about 45 degrees. An actuating roller 37, which displaces and rotates a lever axle (not illustrated here but analogous to the lever axle 3 shown in the FIG. 1), is guided in the actuating guide slot 36. The geometric course of the actuating guide slot 36 is executed in such a manner that the roller double lever 1, or the rollers 2 thereof, during entry between the straight arms 21 have not reached the spreading distance "y". The full entry depth is reached when the actuating roller 37 runs on a linearly extending front edge 40 of the horizontal limb of the actuating cam 32 to achieve the driven-out and rotated-out position of the roller double lever 1 illustrated in the FIG. 2. The roller double lever 1 is retracted in the setting shown in the FIG. 9. The lever axle 3 of the roller double lever 1 with the passive drive P runs in a guide sleeve 39 which is matched to the passive drive and which has the same dimensions and the same internal construction as the guide sleeve 5 with the rotary drive 9. In addition, the coupling pin 7, which is not visible in the small FIGS. 9 and 10, carries at the external end the actuating roller 37.

In a further simplified variant, it is possible to provide the door coupling device or the thrust/rotation unit for the roller double lever 1, even in the case of a center opening door, only at one car door leaf 16.1 or head part 20.1 and nevertheless entrain both shaft door leaves 28. That is realized in the manner that in the head part 29 of the shaft door, a transmission element, which is the same as or similar to the door drive on the car but without drive, is stretched between two rollers, wherein one door leaf 28 is firmly connected with the lower run and the other door leaf is firmly connected with the upper run of the transmission element.

The unlocking, not spoken of up to now, of the shaft door before the opening thereof is not in itself subject of the present invention, but for the sake of completeness shall be briefly explained in the following. A possibility of unlocking, by way of example, consists in that one of the two straight arms 21 is provided to be movable sideways a few millimeters and lifts up a locking pawl by way of a mechanical transmission, for example according to the apparatus shown in the U.S. Pat. No. 5,377,785 which is incorporated herein by reference. For this purpose, one of the straight arms 21 can be, for example for the present entraining principle in adapted form, constructed to be pivotable sideways a few degrees of angle in the manner of a hinge about the vertical axis.

In summary, the present invention relates to the elevator door coupling apparatus for establishing and releasing an operative connection between an elevator car door and an elevator shaft door including a first entraining element mounted on the car door for rotation into engagement with a second entraining element mounted on the shaft door during opening and closing of the shaft door. The roller double lever 1 in the first entraining element is adapted to be rotatably mounted on the head part 20.1, 20.2 supporting the car door leaf 16.1, 16.2 and is displaceable transverse to the car door leaf whereby when the roller double lever is mounted on the head part adjacent the shaft door leaf 28, the roller double lever can be displaced toward the shaft door leaf and rotated into engagement with the second entraining element 21 mounted on the shaft door. The apparatus includes one of the thrust/rotation drive unit D and the passive drive unit P coupled to the roller double lever 1 for rotating and displacing the roller double lever. The thrust/rotation drive unit D is adapted to be mounted above the car door leaf 16.1, 16.2 and the second entraining element 21 is mounted above the shaft door leaf 28 to minimize the threshold gap 35 adjacent bottom edges of the car door leaf and the shaft door leaf.

The thrust/rotation drive unit D includes the guide sleeve 5 in which the lever axle 3 of the roller double lever 1 is mounted for rotation and axial displacement, and the return spring 4 connected to the roller double lever to at least partially retract the axle into the guide sleeve to a predetermined starting setting. The thrust/rotation drive unit D also includes the rotary drive 9 coupled to rotate the entraining disc 8, the coupling pin 7 engaging the entraining disc and radially extending from the coupling ring 6, the coupling ring being axially fixed and rotatable relative to the lever axle 3, and the guide pin 11 radially extending from the lever axle and being guided in the guide slot 10 formed in the guide sleeve 5, the guide slot having the curved portion whereby rotation of the entraining disc by the thrust/rotation drive unit causes the lever axle to extend from the guide sleeve and to rotate the roller double lever 1 as the guide pin moves in the curved portion of the guide slot.

The passive drive unit P includes the actuating cam 32 attached to the door drive support 31 for supporting the car door leaf 16.1, 16.2, the actuating roller 37 attached to the coupling pin 7 and guided in the actuating guide slot 36 formed in the actuating cam whereby movement of the car door leaf 16.1, 16.2 causes the lever axle 3 to extend and to rotate the roller double lever 1 as the guide roller moves in the actuating guide slot.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for coupling elevator doors to establish and release an operative connection between an elevator car door and an elevator shaft door including a first entraining element mounted on the car door for rotation into engagement with a second entraining element mounted on the shaft door during opening and closing of the shaft door comprising: a roller double lever (1) in a first entraining element being adapted to be rotatably mounted on a head part (20.1) supporting a car door leaf (16.1) and displaceable transverse to the car door leaf whereby when said roller double lever is mounted on the head part adjacent a shaft door leaf (28), said roller double lever can be displaced toward the shaft door leaf and rotated into engagement with a second entraining element (21) mounted on the shaft door leaf.

2. The apparatus according to claim 1 including one of a thrust/rotation drive unit (D) and a passive drive unit (P) coupled to said roller double lever (1) for rotating and displacing said roller double lever.

3. The apparatus according to claim 2 wherein said thrust/rotation drive unit (D) is adapted to be mounted above the car door leaf (16.1) and the second entraining element (21) is mounted above the shaft door leaf (28) to minimize a threshold gap (35) adjacent bottom edges of the car door leaf and the shaft door leaf.

4. The apparatus according to claim 2 wherein said thrust/rotation drive unit (D) includes a guide sleeve (5) in which a lever axle (3) of said roller double lever (1) is mounted for rotation and axial displacement, and a return spring (4) connected to said roller double lever to at least partially retract said axle into said guide sleeve to a predetermined starting setting.

5. The apparatus according to claim 4 wherein said thrust/rotation drive unit (D) includes a rotary drive (9) coupled to rotate an entraining disc (8), a coupling pin (7) engaging said entraining disc and radially extending from a coupling ring (6), said coupling ring being axially fixed and rotatable relative to said lever axle (3), and a guide pin (11) radially extending from said lever axle and being guided in a guide slot (10) formed in said guide sleeve (5), said guide slot having a curved portion whereby rotation of said entraining disc by said thrust/rotation drive unit causes said lever axle to extend from said guide sleeve and to rotate said roller double lever (1) as said guide pin moves in said curved portion of said guide slot.

6. The apparatus according to claim 2 wherein said roller double lever (7) includes a lever axle (3) and said passive drive unit (P) includes an actuating cam (32) attached to a door drive support (31) for supporting the car door leaf (16.1), a coupling pin (7) radially extending from a coupling ring (6), said coupling ring being axially fixed and rotatable relative to said lever axle, an actuating roller (37) attached to said coupling pin and guided in an actuating guide slot (36) formed in said actuating cam whereby movement of said car door leaf (16.1) causes said lever axle to extend and to rotate said roller double lever (1) as said guide roller moves in said actuating guide slot.

7. An apparatus for coupling elevator doors to establish and release an operative connection between an elevator car door and an elevator shaft door comprising:

a drive unit (D, P) adapted to be mounted on a head part (20.1) of a car door leaf (16.1);

a roller double lever (1) including a lever axle (3) connected to said drive unit and at least one roller (2) for movement into engagement with an entraining element (21) mounted on a shaft door during opening and closing of the shaft door, said drive unit being operative to rotate said roller double lever about an axis of said lever axle and to axially displace said roller double lever and said lever axle.

8. An apparatus for coupling elevator doors to establish and release an operative connection between an elevator car door and an elevator shaft door comprising:

a rotary drive (9) adapted to be mounted on a head part (20.1) of a car door leaf (16.1);

a guide sleeve (5) attached to said rotary drive;

a lever axle (3) mounted for rotation and axial displacement in said guide sleeve;

a roller double lever (1) attached to said lever axle and including at least one roller (2) mounted thereon;

a return spring (4) connected to said lever axle to at least partially retract said lever axle into said guide sleeve to a predetermined starting setting;

an entraining disc (8) coupled to said rotary drive for rotation thereby;

a coupling ring (6) axially fixed on and rotatable relative to said lever axle;

a coupling pin (7) engaging said entraining disc and radially extending from said coupling ring; and a guide pin (11) radially extending from said lever axle and being guided in a guide slot (10) formed in said guide sleeve, said guide slot having a curved portion whereby rotation of said entraining disc by said rotary drive causes said lever axle to extend from said guide sleeve and to rotate said roller double lever (1) as said guide pin moves in said curved portion of said guide slot.

* * * * *